US005735761A

United States Patent [19]

Palmquist

[11] Patent Number: 5,735,761

[45] **Date of Patent: *Apr. 7, 1998**

[54] SPORTS BALL WITH A PLURALITY OF SURFACE DIMPLES FOR REDUCING THE EFFECTIVE DIAMETER OF BALL

[76] Inventor: Marvin E. Palmquist, 225 Palm Ave., Rockford, Ill. 61107

[ * ] Notice: The term of this patent shall not extend beyond the expiration date of Pat. No. 5,518,234.

[21] Appl. No.: 607,709

[22] Filed: Feb. 27, 1996

Related U.S. Application Data

[62] Division of Ser. No. 237,217, May 3, 1994, Pat. No. 5,518,234.

[51] Int. Cl.[6] ..... A63B 41/08

[52] U.S. Cl. ..... 473/596; 473/604

[58] Field of Search ..... 273/65 EG, 65 E, 273/65 EA, 65 ED, 58 K, 58 D, 58 B, 58 BA; D21/205; 473/128, 125, 569, 572, 573, 574, 596, 597, 603, 604, 613, 614

[56] References Cited

U.S. PATENT DOCUMENTS

| | | | |
|---|---|---|---|
| 2,448,731 | 9/1948 | Park | 273/65 EG |
| 4,000,894 | 1/1977 | Butzen | 273/65 EG |
| 4,570,931 | 2/1986 | Martin | 273/65 EG |
| 4,928,962 | 5/1990 | Finley | 273/65 EG |
| 4,991,842 | 2/1991 | Finley | 273/65 EG |
| 5,195,745 | 3/1993 | Rudell et al. | 273/65 EG |
| 5,269,514 | 12/1993 | Adler et al. | 273/65 EG |
| 5,431,393 | 7/1995 | Wang | 273/65 EG |
| 5,518,234 | 5/1996 | Palmquist | 273/65 EG |

*Primary Examiner*—Seven B. Wong

*Attorney, Agent, or Firm*—Cumpston & Shaw

[57] ABSTRACT

A sports ball having a convex surface with a plurality of dimples formed in the surface. The dimples are sized to receive a substantial portion of a finger tip of a user so as to permit the easier grasping of the ball. The dimples are spaced apart and sized so that upon grasping the ball a given fingertip substantially occludes only a single dimple. For a spherical ball the size of a regulation basketball, the dimples create the general appearance of the known golf ball.

12 Claims, 2 Drawing Sheets

FIG. 2
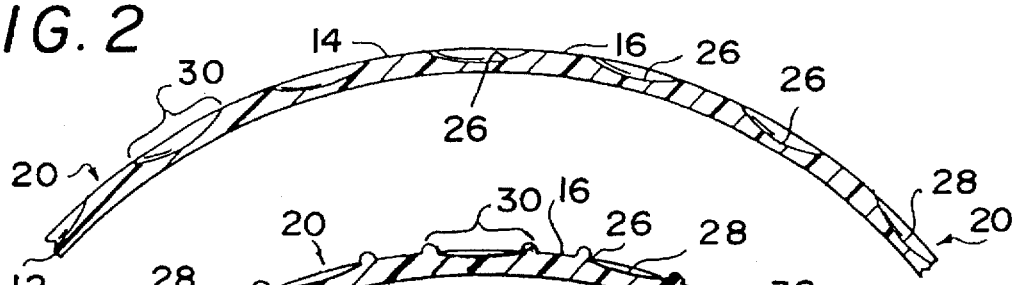
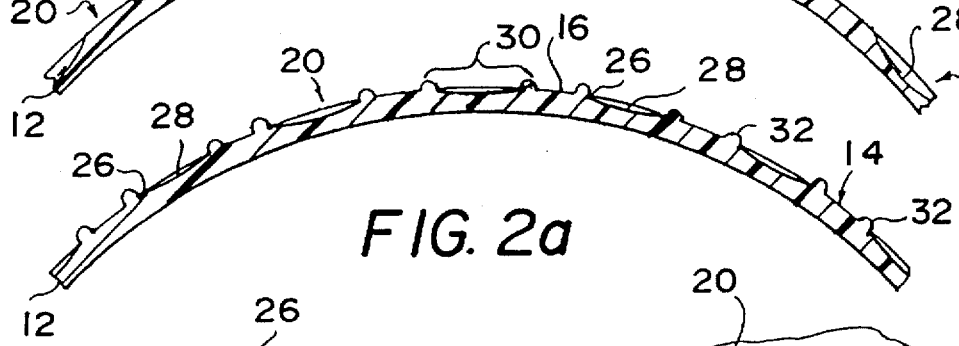
FIG. 2a
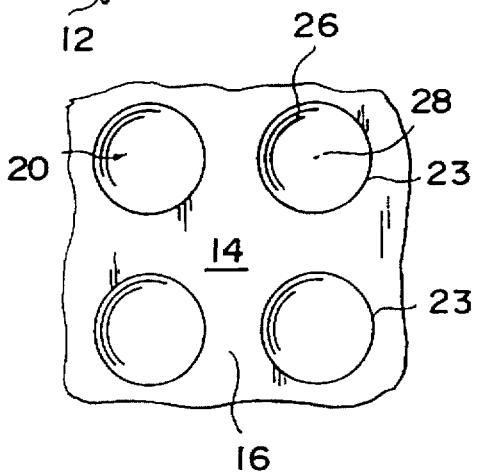
FIG. 3
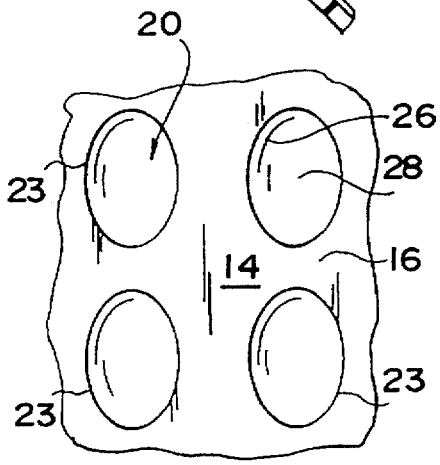
FIG. 4
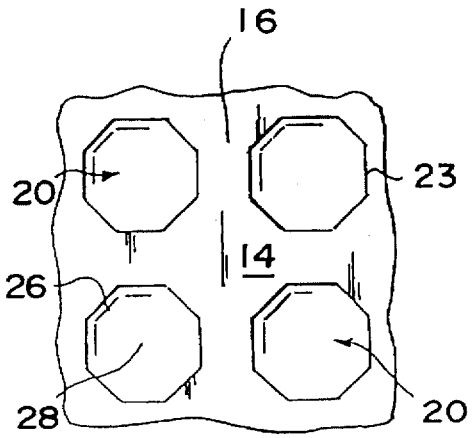
FIG. 5
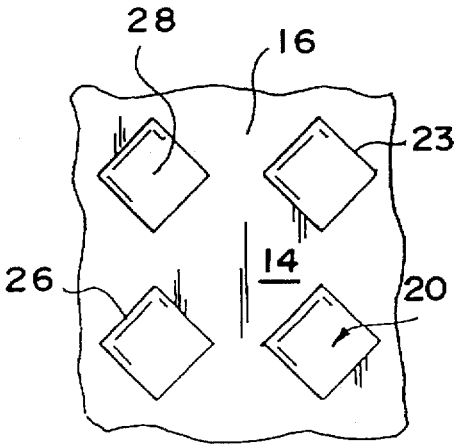
FIG. 6

SPORTS BALL WITH A PLURALITY OF SURFACE DIMPLES FOR REDUCING THE EFFECTIVE DIAMETER OF BALL

The present application is a divisional of U.S. Ser. No. 08/237,217 filed May 3, 1994, now U.S. Pat. No. 5,518,234.

FIELD OF THE INVENTION

The present invention relates to sports balls, and more particularly, to a ball having a convex surface, wherein at least a portion of the convex surface includes a plurality of spaced apart dimples sized and spaced so that a given fingertip of a player operably engages only a single dimple to permit the player to effectively grasp the ball.

BACKGROUND OF THE INVENTION

As the promotion and distribution of sports increases on a national and international basis, a larger segment of the population is exposed to sports. A number of popular sports employ balls that are grasped or manipulated by the hands. A number of these sports employ inflatable balls. A popular game that employs an inflatable or elastic ball is basketball. The increased promotion of basketball has exposed the game to more and more players over a wide range of ages, sizes and skill levels are participating in the game. The relative size and skill level of many professional players permit the professional players to perform certain feats with a ball which are substantially unattainable by the average sized or nonprofessional player or youths participating in the game.

In prior attempts to accommodate the varying skill levels or age groups of participants, basketballs have had reduced diameters. That is, basketballs for children often have a diameter which is substantially less than the diameter of a regulation size NBA basketball. As the child grows, their hands are better able to grasp and control a regulation size basketball. However, even as the player matures it may remain extremely difficult to control the regulation size ball.

Although regulation size basketballs have a plurality of interconnected seams in the surface of the ball, the seams are spaced so that only a portion of one or two fingertips may engage the seams. In fact, there are many orientations of the basketball where the player cannot effectively engage any of the seams. The seams are also located such that generally only one or two digits engage the seams.

The exterior surface of conventional basketballs has an embossed or formed grain pattern formed of pebble-like projections or blisters on the exterior surface. These pebble-like projections are convex, rounded and generally hemispherical in shape, with each projection separated from its neighboring projection by recessed bands or valleys. The valleys are much narrower in width than the average diameter of the projections, and form a substantially continuous, interconnected network over the surface of the ball. The junctures or intersections at which the valleys separating three or more projections converge are also much narrower than the average diameter of the projections. The individual pebble projections have a diameter or width dimension of approximately 0.0625 (1/16) to 0.125 (1/8) inches [1.6 mm to 3.2 mm], and project from the surrounding surface of the ball by approximately 0.03125 (1/32) inches [0.8 mm]. As disclosed in U.S. Pat. No. 4,000,894, the individual grain pebbles have a diameter (width) to depth ratio ranging from approximately 3 to approximately 6.25.

In conventional sports balls having exterior surfaces made of leather, the pebble grain is embossed onto the.. leather by applying pressure using a suitable stamping device. In balls having synthetic non-leather exterior surfaces, the pebble grain is applied during injection or compression molding of the surface piece, or, alternatively, embossed using heat and/or pressure.

Regardless of the technique used to apply the pebble grain to conventional sports balls, the resulting pebble-like projections provide enhanced gripping characteristics as compared to balls having smooth exterior surfaces. In particular, a player's fingers and palm will conform to the grain of the ball such that the skin will compress against a plurality of pebble-like projections but remain uncompressed or less compressed with respect to the valleys surrounding the projections. It is believed enhanced gripping of the basketball results from the frictional interaction between the multiple projections and skin of the player's hand.

Previously, a football was proposed which had a reverse grain pebble pattern consisting of substantially circular recesses formed on the exterior surface of the ball. The recesses of the prior design were formed with orthogonal walls extending inwardly from the exterior surface of the ball and ending at a substantially flat bottom portion. The orthogonal walls defining the recesses in the prior design formed a sharp circular lip at their intersection with the exterior surface of the ball. Thus, friction was created when a player's fingers and palm compressed the raised portions of the ball but remained relatively uncompressed by the recesses. The prior reverse grain football was therefore less tactically appealing than conventional footballs.

U.S. Pat. Nos. 4,928,962 and 4,991,842 disclose a reverse grained football and basketball, wherein the surface pattern has recesses and ridges that are similar in number and size to the pebble-like projections of a conventional football and basketball. Alternatively, an increased number of seams or grooves have been employed to enhance the grasp upon the ball, such as in U.S. Pat. Nos. 2,859,040; 5,133,550; and 5,165,685.

However, a need still exists for a sports ball which may be of a regulation size yet provide enhanced gripping characteristics. A further need exists for a sports ball having a novel appearance and having a configured surface for enhancing the grip of the ball. The need also exists for a grip enhancing configuration that may be applied to a variety of sports balls having convex surfaces.

SUMMARY OF THE INVENTION

According to the present invention, a sports ball has a convex outer surface with a plurality of dimples disposed in at least a portion of the outer surface, wherein the dimples have a size and spacing so that upon contact with the ball a fingertip engages only a single dimple. As used herein the term "fingertip" is generally defined by the outer end of the third or outer phalange. In a preferred embodiment, the dimples have a diameter and depth so that at least a substantial portion of a fingertip is accommodated in a single dimple to permit grasping of the ball by a plurality of finger tips each engaging its own dimple, thereby reducing the effective diameter of ball. The dimples may have a diameter to depth ratio of approximately 20 to 100. In fact, even if the present dimples had a depth of approximately 1 mm, the diameter to depth ratio is still at least approximately 10. The dimples form grasping surfaces which intersect the adjacent convex surface of the ball to assist in manipulation of the ball, wherein only a single grasping surface is operably contacted by a single finger tip. The positioning and spacing of the dimples are such that upon any orientation of the ball, each of the player's outer phalanges readily and cooperatively engage their own dimple without distending or substantially distorting the fingers, thereby permitting the player to exert a control force on the ball through each of the finger tips.

In a spherical embodiment of the ball, the dimples are sized and spaced so that a white ball having the diameter of a basketball substantially simulates the appearance of a golf ball.

BRIEF DESCRIPTION OF THE DRAWINGS

FIG. 2 is a partial cross sectional view showing the location of the dimples in the outer surface of the ball;

FIG. 2*a* is a partial cross sectional view showing the location of the dimples with ridges in the outer surface of the ball.

FIG. 3 is a local plan view showing dimples having a substantially circular periphery;

FIG. 4 is a local plan view showing dimples having an oval, obround periphery;

FIG. 5 is a local plan view showing dimples having a polygonal periphery and specifically a octagonal periphery; and FIG. 6 is a local plan view showing dimples having a square periphery, wherein the dimples are oriented to represent diamonds.

DETAILED DESCRIPTION OF THE PREFERRED EMBODIMENTS

Figure 1:
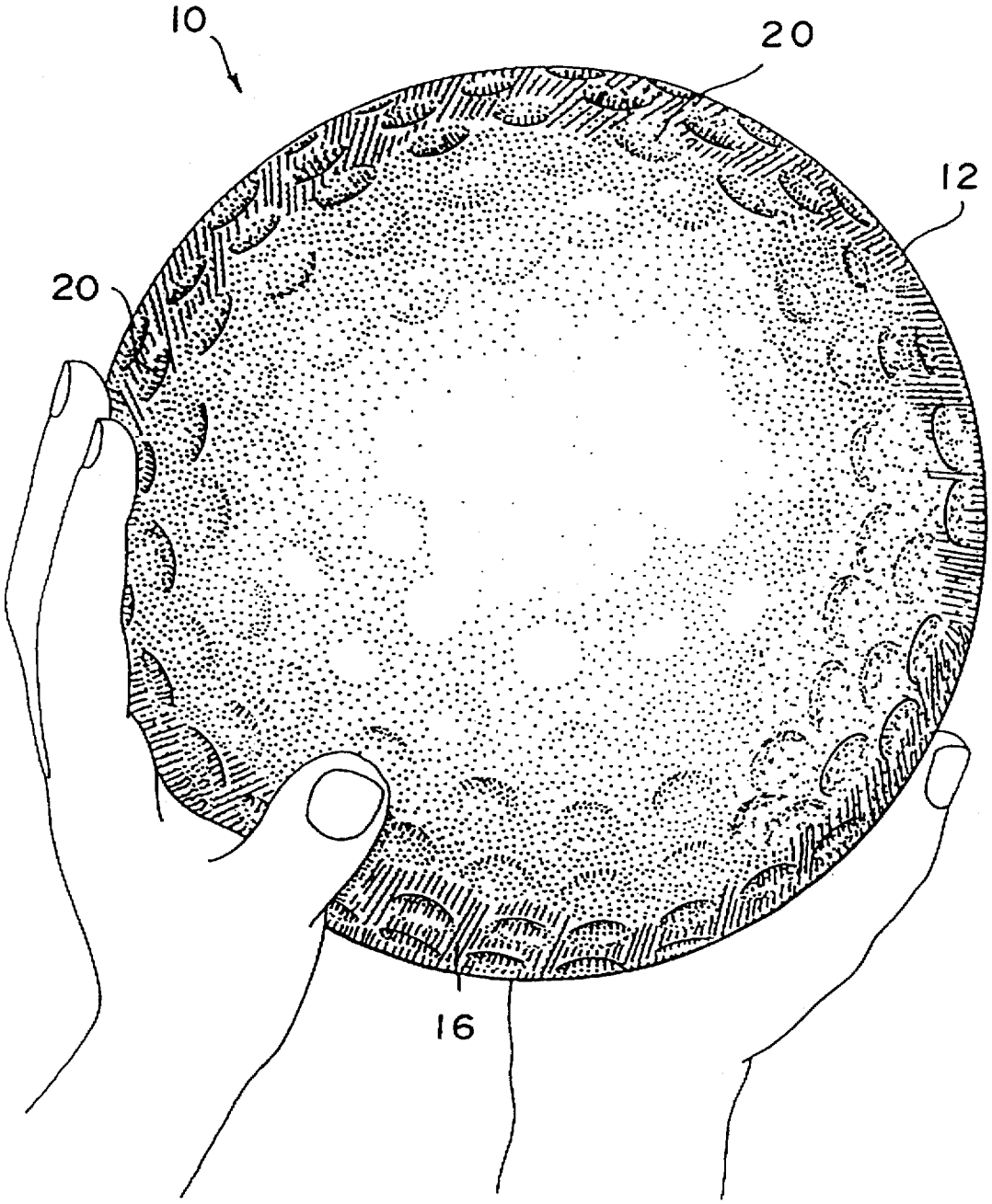
FIG. 1 is perspective view of a spherical ball showing the fingers contacting the ball.

Referring to FIG. 1, the present invention includes a sports ball 10 having a spherical outer surface 11, wherein the outer surface includes a plurality of dimples 20. Although the present invention is described in terms of an inflatable spherical sports ball 10 such as a basketball, it is understood that the present surface may be employed on any inflatable or noninflatable ball or sports ball. Further, the present invention may be applied to a non spherical, or prolate spheroid ball and specifically a prolate spheroid having pointed ends such as a football, or any ball having an outer surface which includes a convex portion to be grasped by the hand and particularly the fingertips.

The basketball 10 of the form and shape conventionally used in the game of basketball is illustrated. The basketball 10 is substantially spherical or round in shape and preferably comprises an inflated rubber bladder (not shown) enclosed in the cover 12. The outer surface 11 of cover 12 is formed of a layer of leather, rubber or plastic material well known in the art for forming indoor, outdoor or indoor/outdoor basketballs. As shown in FIG. 2, the cover 12 has a sufficient thickness to include the dimples 20. Traditionally, the cover 12 of an ordinary basketball includes 8 panels joined at, or delineated by a circumferential seam. The ball 10 is inflated by the introduction pressurized air into the bladder through a valve 18 (not shown).

Dimple Periphery

Referring to FIG. 1, the dimples 20 are sized and shaped so that only a single dimple engages a substantial portion of a player's fingertip. The dimples 20 are defined by a periphery 23 sufficiently large and spaced apart from adjacent peripheries to permit at least a substantial portion of a fingertip to be received within a given dimple. In a first embodiment, the dimples 20 are defined by circular peripheries having a diameter of approximately 10 mm to 20 mm, with a preferred diameter of approximately 16.5 mm. As shown in FIGS. 3–6, the dimples 20 may also be defined by a periphery 23 having a plurality of arcuate segments or alternatively, linear segments. The dimples 20 may have rectangular, square, or higher polygonal peripheries. The dimples 20 include a sufficient major dimension, or width to permit occupation by substantially an entire fingertip.

Dimple Sizing

The dimples 20 are sized so that upon grasping the ball 10, a given fingertip will engage a single dimple, and engagement in multiple dimples is generally precluded. While this parameter depends in part upon the size of the user, the dimple 20 has a minimum dimension sufficient to receive a substantial portion of a finger tip and preclude engagement of a plurality of dimples by a given finger tip. That is, only a single dimple is substantially occluded or filled by a given fingertip. The intradimple spacing from dimple center to dimple center may be from 20 mm to 35 mm.

Dimple Depth

The dimples 20 may have a depth from approximately 0.5 mm to 0.2 mm. The depth of the dimples is defined by a side wall 26 which extends from the periphery 23 at the outer opening to a bottom, or bottom wall 28. Referring to FIG. 2, the side wall 26 is curvilinear (dish shaped) substantially defined by a flattened spherical segment. Alternatively, the side wall 26 may be formed by a plurality of linear segments or facets such that the bottom wall 28 is reduced to substantially a point. However, the side wall 26 may be defined by a relatively small radius so that the bottom wall 28 extends across a substantial portion of the area within the periphery 23. The bottom wall 28, side wall 26 and periphery 23 form a grasping surface 30 for contact with a fingertip. The curvature of the sidewall 26 in each dimple 20 defines a portion of the grasping surface 30, wherein the grasping surface intersects the adjacent ball surface 14. The grasping surface 30 may form a discontinuity or a curve it intersects the adjacent ball surface 14 at the periphery 23. That is, the periphery 23 may be defined by a radius or substantially a line.

Dimple Spacing

The dimples 20 may be spaced in a regular pattern about the ball 10 as shown in FIG. 1, and partially shown in FIGS. 2–6. In the preferred embodiment, 32 dimples 20 are disposed about the 29.5 inch circumference of the basketball. There are seven rows of dimples extending about the ball 10, wherein the dimple count ranges from 32 at the equator to 4 dimples which surround the pole. The dimples 20 are separated by interconnecting ribs 16 which generally define the overall convex shape of the ball 10. That is, the portion of the outer surface 11 between the dimples 20 defines the overall shape of the ball 10.

The periphery 23 of the dimples 20 are spaced apart by the ribs 16 having a width of approximately 0.3125 (5/16) inches from the nearest dimple in the same or adjacent row and approximately 0.625 (5/8) inches from the further spaced dimple in the adjacent row.

The dimples 20 may be substantially equally spaced from all adjacent dimples or may be spaced so that the adjacent dimples in one direction are a first distance and adjacent dimples in a perpendicular direction are a second different distance. The spacing is sufficient to separate adjacent dimples 20 so that only a single fingertip engages a single dimple. Alternatively, the dimples 20 may be disposed in a random pattern about the ball, wherein the spacing defined by the ribs 16 is sufficient to preclude engagement of a single dimple by more than a single fingertip.

The ribs 16 may be defined entirely by the local curvature of the ball 10, as shown in FIG. 2. Alternatively, the ribs 16 may include a peripheral ridge 32 which extends about the periphery 23 of the dimples 20, as shown in FIG. 2*a*. That is, the peripheral ridge 32 creates an effective depth of the dimple 20 that is greater than the actual elevational change from the bottom wall 28 to the adjacent ball surface 14. The ridges 32 increase the size of the grasping surface 30 engaged by a given fingertip. The ridges 32 may have a cross-sectional profile that is defined by a circular segment, arcuate length, or plurality of linear facets. It is contemplated that the width of the ridges 32 is less than approximately 25 percent of the diameter of the dimple 20.

Effective Radius of the Ball

As the dimples 20 are sized to receive a finger tip therein, the dimples and grasping surface 30 define an effective radius of the ball which is less than the radius defined by the outer convex surface 11. That is, the reduced radius defining the bottom wall 28 and side wall 26 of the dimples 20 provides for a reduced arc length between dimples contacted by the fingertips of the player. The reduced arc length and hence effective ball size allows a player to efficiently manipulate a ball having a larger convex surface than is otherwise possible.

Performance Characteristics

It is believed the present dimples 20 have a sufficient size and spacing to reduce the effective drag of a ball 10, thereby improving the flight characteristics. That is, the dimples 20 provide for truer flight and increased resistance to wind influences. The dimples 20 increase the aerodynamic stability of the ball 10.

The sports ball 10 may be formed without the 8 panels and seams of a traditional basketball. However, it is understood that the seams may be formed in the outer surface 11, such that the seams intersect a number of the dimples 20. In addition, the relative size of the present dimples 20 permits the formation of the previous reverse pebble pattern in the present ball 10. The reverse pebble pattern may be formed on the outer surface at the ribs 16 intermediate of the dimples 20, on the dimples and the grasping surface 30, or on both the outer surface and the dimples. Alternatively, all or portions of the surfaces of the ball 10 may include the traditional raised or embossed pebble structure.

In a specific embodiment of the present invention, the dimples are sized and spaced so that on a spherical white ball the size of a regulation basketball, the appearance of the well known golf ball is created. That is, but for the size, a dimpled ball 10 the size of a basketball closely resembles the appearance of a golf ball.

It will be understood that since the shape of a ball is spherical, a polygonal shape, such as a hexagon on the surface of the ball, is not a true polygon with straight sides. Rather, the sides of the polygon curve over the convex surface along arcs of circles or ellipses. As used herein, planar terms such as "polygon", "hexagon", "parallel", and "flat" surfaces refer to the projection of the three dimensional surface onto a planar surface.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. A game bail, comprising:

(a) a body having a convex outer surface including a multitude of depressed surfaces forming fingertip engageable dimples spaced apart around substantially the entire outer surface of the game bail to permit a player's fingertips to grasp the game ball by engaging a plurality of the dimples from any of a multitude of locations around the periphery thereof, each of the dimples being sufficiently wide and deep to accommodate only one of the player's fingertips for allowing the player to grasp and manipulate the game ball significantly more efficiently than would otherwise be possible in the absence of the dimples.

2. The game ball of claim 1, wherein said bail is inflatable.

3. A game ball, comprising:

(a) an inflatable body having an outer surface including a multitude of depressed surfaces forming fingertip engageable dimples distributed about substantially the entire outer surface to permit a player's fingertips to grasp the game ball by engaging a plurality of the dimples from any of a multitude of locations around the periphery thereof, each of the dimples being sufficiently wide and deep to accommodate only one of the player's fingertips for allowing the player to grasp and manipulate the game ball significantly more efficiently than would otherwise be possible in the absence of the dimples.

4. A game bail for manipulation by the hands and finger tips of a player, comprising:

(a) an outer convex surface having a multitude of spaced apart dimples disposed about at least half the outer convex surface, the dimples defined by a periphery and a predetermined spacing intermediate adjacent dimples, the periphery and the predetermined spacing selected to permit a player's fingertips to grasp the game bail by engaging a plurality of the dimples from any of a multitude of locations around the periphery thereof, each of the dimples being sufficiently wide and deep to accommodate only one of the player's fingertips for allowing the player to grasp and manipulate the game ball significantly more efficiently than would otherwise be possible in the absence of the dimples.

5. The game ball of claim 1 wherein the dimples are spaced apart by an interdimple spacing, wherein the interdimple spacing is between approximately 20 mm and approximately 35 mm, the dimples having a periphery defined by a width of approximately 10 mm to approximately 20 mm, and a dimple depth between approximately 0.5 mm and 0.2 mm.

6. The game ball of claims 1, 3 or 4, wherein the ball is a basketball.

7. The game ball of claims 1, 3 or 4, wherein the dimples are randomly located in the outer surface.

8. The game ball of claims 1, 3 or 4, wherein the dimples are located in a repeating pattern in the outer surface.

9. The game ball of claims 1, 3 or 4, wherein the dimples are defined by a circular periphery.

10. The game ball of claims 1, 3 or 4, wherein the interdimple spacing between adjacent dimples is substantially equal.

11. The game ball of claims 1, 3 or 4, wherein a given dimple is adjacent a plurality of dimples and the interdimple spacing between the given dimple and at least two adjacent dimples is unequal.

12. The game ball of claims 1, 3 or 4, such that upon engagement with a pair of spaced apart dimples, the apparent diameter of the ball is reduced.

* * * * *